US009234525B2

(12) United States Patent
Voong et al.

(10) Patent No.: US 9,234,525 B2
(45) Date of Patent: Jan. 12, 2016

(54) COMPRESSOR WHEEL

(75) Inventors: Michael Voong, Homfirth (GB); Tom J. Roberts, Huddersfield (GB); Katie Rhodes, Barnsley (GB); Luke Hankin, Gams (CH)

(73) Assignee: Cummins Turbo Technologies Limited, Huddersfield (GB)

( * ) Notice: Subject to any disclaimer, the term of this patent is extended or adjusted under 35 U.S.C. 154(b) by 898 days.

(21) Appl. No.: 12/951,596

(22) Filed: Nov. 22, 2010

(65) Prior Publication Data

US 2011/0229338 A1 Sep. 22, 2011

(30) Foreign Application Priority Data

Nov. 21, 2009 (GB) ..... 0920436.3

(51) Int. Cl.
*F01D 5/14* (2006.01)
*F04D 29/28* (2006.01)
*F04D 29/02* (2006.01)

(52) U.S. Cl.
CPC ..... *F04D 29/284* (2013.01); *F04D 29/023* (2013.01); *Y10T 29/4932* (2015.01)

(58) Field of Classification Search
CPC ..... F04D 29/023; F04D 29/284
USPC ..... 29/889.21; 415/58.4; 416/224, 241 R, 416/223 A, 223 B
See application file for complete search history.

(56) References Cited

U.S. PATENT DOCUMENTS

| | | | | |
|---|---|---|---|---|
| 2,920,007 | A * | 1/1960 | Buckland | 148/410 |
| 4,705,463 | A | 11/1987 | Joco | |
| 5,868,552 | A | 2/1999 | McKean et al. | |
| 8,021,117 | B2 * | 9/2011 | Kubota | 416/175 |
| 8,113,787 | B2 * | 2/2012 | Barril et al. | 416/224 |
| 2009/0274560 | A1 | 11/2009 | Kubota et al. | |
| 2010/0215506 | A1 * | 8/2010 | Heyes et al. | 416/241 R |

FOREIGN PATENT DOCUMENTS

| | | | |
|---|---|---|---|
| CN | 85107317 | A | 7/1986 |
| DE | 102006048784 | A1 | 4/2008 |
| EP | 1 541 717 | A2 | 11/2004 |
| EP | 1541717 | A2 | 6/2005 |

(Continued)

OTHER PUBLICATIONS

United Kingdom Search Report GB0920436.3, Cummins Turbo Technologies Limited, Mar. 12, 2010.

(Continued)

*Primary Examiner* — Igor Kershteyn
*Assistant Examiner* — Woody A Lee, Jr.
(74) *Attorney, Agent, or Firm* — Taft, Stettinius & Hollister LLP

(57) ABSTRACT

A compressor wheel for a turbocharger comprising a central hub and a plurality of impeller blades extending outwardly from the hub. Each of the blades defines a leading edge, a trailing edge and a root portion which connects the blade to the hub. At least one of the blades has a surface provided with a variable thickness surface layer of a ceramic material. The leading edge of the blade is provided with a thicker surface layer of the ceramic material than the trailing edge of the blade, the root portion of the blade, or both the trailing edge and root portion of the blade.

13 Claims, 2 Drawing Sheets

(56) References Cited

FOREIGN PATENT DOCUMENTS

| | | | | | |
|---|---|---|---|---|---|
| EP | 2022987 | A1 | | 2/2009 | |
| JP | 62-211389 | | | 9/1987 | |
| WO | WO 2006/126993 | A1 | | 11/2006 | |
| WO | WO 2007/089567 | A1 | | 8/2007 | |
| WO | WO 2008/043539 | | * | 4/2008 | ..... F02C 6/12 |
| WO | WO 2008/043539 | A1 | | 4/2008 | |

OTHER PUBLICATIONS

Chinese Office Action, Dec. 24, 2013, pp. 1-9, Chinese Patent Application No. 2010106244904, China.
European Examination Report, Jun. 6, 2014, pp. 1-4, European Patent Office, Netherlands.
English Translation of DE102006048784.
English Translation of EP1541717.

* cited by examiner

COMPRESSOR WHEEL

CROSS REFERENCE TO RELATED APPLICATIONS

The present application claims priority to United Kingdom Patent Application No. 0920436.3 filed Nov. 21, 2009 which is incorporated herein by reference.

The present invention relates to a compressor wheel suitable for use in a turbocharger for an internal combustion engine, particularly but not exclusively a variable geometry turbocharger.

Turbochargers are well known devices for supplying air to the intake of an internal combustion engine at pressures above atmospheric pressure (boost pressures). A conventional turbocharger essentially comprises a housing in which is provided an exhaust gas driven turbine wheel mounted on a rotatable shaft connected downstream of an engine outlet manifold. Rotation of the turbine wheel rotates a compressor wheel mounted on the other end of the shaft. The compressor wheel delivers compressed air to the engine intake manifold. The turbocharger shaft is conventionally supported by journal and thrust bearings, including appropriate lubricating systems.

Turbines may be of a fixed or variable geometry type. Variable geometry turbines differ from fixed geometry turbines in that the size of the turbine inlet passage can be varied to optimise gas flow velocities over a range of mass flow rates so that the power output of the turbine can be varied to suit varying engine demands. In one known type of variable geometry turbine, an array of axially extending vanes is connected to one wall of the turbine inlet passage so as to extend across the inlet passage. The separation of the wall carrying the vanes and the facing wall of the inlet passage is fixed. In this type of turbine, commonly referred to as a "swing vane" turbine, the size of the inlet passage is controlled by varying the angle of the vanes relative to the direction of gas flow through the turbine inlet. In another known type of variable geometry turbine, an axially moveable wall member, generally referred to as a "nozzle ring", defines one wall of the inlet passage. The position of the nozzle ring relative to a facing wall of the inlet passage is adjustable to control the axial width of the inlet passage. Thus, for example, as gas flow through the turbine decreases, the inlet passage width may be decreased to maintain gas velocity and optimise turbine output.

Nitrogen oxides (NOx) are generated by an internal combustion engine as a result of nitrogen and oxygen reacting at the very high temperatures typically generated within the engine's combustions chamber (around 2500° F. or above). In an effort to reduce NOx emissions exhaust gas recirculation (EGR) systems have been developed. In these systems, a portion of the engine's exhaust gas is recirculated back to the engine cylinders where it replaces any excess oxygen in the pre-combustion mixture (typical in diesel engines) and/or increases the amount of matter in the engine cylinders with the result of allowing similar pressures to be obtained at lower temperatures (typical in petrol engines). Reducing the temperatures reached within the combustion chamber reduces the likelihood of nitrogen and oxygen combining to produce NOx emissions. "Long-route" or "low pressure" EGR systems operate by passing a portion of the exhaust gases from the exhaust gas outlet of a turbocharger to the inlet of the turbocharger compressor where the gases mix with incoming ambient air. An unfortunate result of such systems is that the compressor wheel is exposed to any corrosive species or particulate matter entrained within the incoming exhaust gas/air mixture, which can reduce the fatigue life of the compressor wheel and lead to premature failure.

Premature failure can also result from compressor wheels being exposed to potentially harmful species in engines not including EGR systems. By way of example, the crank case of an engine is sometimes vented to the engine air intake to avoid releasing potentially harmful pollutants to the atmosphere. As a result, however, the compressor wheel of a turbocharger mounted to such an engine can be exposed to these pollutants with similar results to an engine incorporating an EGR system.

It is an object of the present invention to obviate or mitigate one or more of the problems set out above.

According to a first aspect of the present invention there is provided a compressor wheel for a turbocharger comprising a central hub and a plurality of impeller blades extending outwardly from the hub, each of the blades defining a leading edge, a trailing edge and a root portion which connects the blade to the hub, wherein at least one of the blades has a surface provided with a variable thickness surface layer of a ceramic material, the leading edge of the blade being provided with a thicker surface layer of the ceramic material than the trailing edge and/or root portion of the blade.

In this way, the present invention for the first time addresses problems associated with compressor wheel fatigue life and compressor wheel corrosion. The leading edge of the impeller blade which is exposed to the greatest amount of incoming potentially harmful species and particulate matter at greatest velocity is provided with a relatively thick protective ceramic coating while the trailing edge and/or blade root is provided with a thinner coating to afford adequate protection against corrosion but avoiding significantly reducing the fatigue life of the blade, which is known to be a problem associated with ceramic coated components in high stress operating environments.

According to a second aspect of the present invention there is provided a turbocharger, such as a variable geometry turbocharger, comprising:

- a housing;
- a turbine wheel supported on a shaft within said housing for rotation about a turbine axis; and
- a compressor wheel supported on said shaft within said housing, said compressor wheel comprising a central hub and a plurality of impeller blades extending outwardly from the hub, each of the blades defining a leading edge, a trailing edge and a root portion which connects the blade to the hub,
- wherein at least one of the impeller blades has a surface provided with a variable thickness surface layer of a ceramic material, the leading edge of the blade being provided with a thicker surface layer of the ceramic material than the trailing edge and/or root portion of the blade.

A third aspect of the present invention provides a method for manufacturing a compressor wheel for a turbocharger, the compressor wheel comprising a central hub and a plurality of impeller blades extending outwardly from the hub, each of the blades defining a leading edge, a trailing edge and a root portion which connects the blade to the hub, wherein the method comprises providing a surface of at least one of the blades with a variable thickness surface layer of a ceramic material such that the leading edge of the blade is provided with a thicker surface layer of the ceramic material than the trailing edge and/or root portion of the blade.

It is preferred that said surface of the at least one blade is subjected to plastic deformation prior to the provision of the layer of ceramic material. The plastic deformation of the compressor wheel blade(s) may be achieved using any appropriate process, such as laser peening, although it is preferred that shot peening is employed. The layer of ceramic material is preferably provided on the surface of the at least one blade by an oxidation process, such as plasma electrolytic oxidation or anodisation as discussed more fully below. It is preferred that the layer of ceramic material is treated with a sealant, such as a suitable fluoropolymer, sol-gel or silicate for reasons explained more fully below.

In a fourth aspect of the present invention there is provided a compressor wheel for a turbocharger comprising a central hub and a plurality of impeller blades extending outwardly from the hub, each of the blades defining a leading edge, a trailing edge and a root portion which connects the blade to the hub, wherein at least one of the blades has a plastically deformed surface provided with a surface layer of a ceramic material.

A fifth aspect relates to a turbocharger such as a variable geometry turbocharger, comprising:

a housing;

a turbine wheel supported on a shaft within said housing for rotation about a turbine axis; and a compressor wheel supported on said shaft within said housing, said compressor wheel comprising a central hub and a plurality of impeller blades extending outwardly from the hub, each of the blades defining a leading edge, a trailing edge and a root portion which connects the blade to the hub, wherein at least one of the impeller blades has a plastically deformed surface provided with a surface layer of a ceramic material.

A sixth aspect provides a method for manufacturing a compressor wheel for a turbocharger, the compressor wheel comprising a central hub and a plurality of impeller blades extending outwardly from the hub, each of the blades defining a leading edge, a trailing edge and a root portion which connects the blade to the hub, wherein the method comprises subjecting a surface of the at least one blade to plastic deformation and providing said surface with a surface layer of a ceramic material.

The compressors and turbochargers of the above-defined aspects of the present invention are eminently suitable for use with any type of turbocharged internal combustion engine, such as a diesel, gasoline direct injection or conventional petrol engine, where a more durable compressor wheel is desired or needed. Such requirements can arise for a number of different reasons, including, but not limited to engines incorporating exhaust gas recirculation (EGR) systems and/or closed crank case ventilation (CCV) systems.

A preferred embodiment of the second and/or fifth aspects of the present invention provides the turbocharger connected to an exhaust gas recirculation system to take a portion of the exhaust gases exiting the turbine stage and recirculate them back to the compressor stage with incoming ambient air. The improved impeller blades of the present invention can withstand the more corrosive species and more harmful particulate matter entrained in the exhaust gases being fed to the compressor. The improved impeller blades are therefore more durable and less likely to fail under such circumstances than conventional impeller blades.

In respect of any of the above-defined aspects of the present invention, preferably the surface of the or each blade has been plastically deformed using an appropriate method, such as shot peening. Subjecting the surface of the compressor wheel blade(s) to plastic deformation induces a residual compressive stress in the surface which reduces or prevents cracks from forming and/or propagating throughout the blade structure. Producing compressor wheel blades with a surface which has been subjected to both plastic deformation and formation of a variable thickness ceramic layer produces a blade which is unexpectedly hard and resilient to corrosion, whilst also exhibiting excellent long cycle fatigue life performance.

In the compressor and/or turbocharger of the present invention the impeller blades and the compressor wheel hub may be manufactured from any suitable material, most preferably aluminium using any appropriate method, such as casting, machined from solid (MFS) or semi-solid molding (SSM). The blades may be manufactured or incorporate titanium and/or magnesium, but in each case, it is preferred that the blade surfaces are provided with a coating of an oxide or ceramic of the material from which the blades are manufactured prior to undergoing further treatment. By way of example, the blades may be machined from solid aluminium in which case the coating is preferably an aluminium oxide coating, most preferably an aluminium oxide conversion coating produced by oxidising a surface of the aluminium blade. When the blades are produced from titanium and/or magnesium, or one or more surfaces of the blades comprise titanium and/or magnesium the coating provided on the titanium or magnesium surface may be an oxide of that material produced using, for example, plasma electrolytic oxidation or anodising.

The ceramic material is preferably an oxide of the substrate material from which the blades are formed. The ceramic layer of variable thickness can be obtained using any suitable process, such as anodising or, more preferably, plasma electrolytic oxidation (PEO), which in view of the higher potentials typically used as compared to conventional anodising, results in harder layers of more crystalline ceramic materials. It will be appreciated by the skilled person that the PEO process is often known generically as 'plasma electrolysis', and is also sometimes referred to as 'micro-arc oxidation', 'microplasma oxidation', 'anode spark electrolysis', 'plasma electrolytic anode treatment', and 'Anodischen Oxidation unter Funkenentladung' (anode oxidation under spark discharge). All of these processes are in fact essentially the same in that they create an oxide coating through plasma discharge of the component surface.

The PEO process employs a bath of electrolyte which usually consists of a dilute alkaline solution containing low concentrations of compounds such as KOH, NaOH, $Na_2SiO_3$, $NaAlO_2$, $H_2SO_4$, NaF—$Na_2CO_3$, $Na_3P_2O_7$ or similar. The component to be coated, i.e. the impeller blade, is electrically connected, so as to become one of the electrodes in an electrochemical cell, with the other electrode usually being a stainless steel counter-electrode. Typically, potentials of over 200V are applied between the two electrodes creating plasma on the surface of the component. The coating process may employ continuous or pulsed direct current (DC), alternating current (AC) or "pulsed bi-polar" operation.

In a preferred embodiment the ceramic material is aluminium oxide produced by surface oxidation of an aluminium compressor wheel with integral aluminium impeller blades using plasma electrolytic oxidation so that at least some of the usually amorphous aluminium oxide is converted to its much harder crystalline form.

The blade(s) provided with the variable thickness ceramic layer preferably incorporates a thicker layer of ceramic material that is up to around 40 microns thick at the leading edge of the or each blade, and a thinner ceramic layer that is up to around 10 microns thick at the trailing edge and/or root of the or each blade. The coating may be applied to the inducer portion of one or more of the impeller blades and the exducer portion of one or more of the impeller blades, or may be applied to just the inducer or exducer portion of one or more of the blades.

The leading edge ceramic layer may have a thickness of around 10 to 40 microns, more preferably around 15 to 25 microns. It is particularly preferred that the ceramic layer has a thickness that is around 10 to 25 microns, more preferably around 14 to 20 microns within 1 mm of the leading edge of the coated blade(s). The relatively thick ceramic layer is preferably provided at or adjacent to the leading edge of an inducer portion of the blade(s) since this is the area of the blade(s) which is exposed to the greater quantity of incident species which might corrode or erode the blade(s). That being said the coating may alternatively or additionally be provided on the leading edge of the exducer portion of the blade(s) since this area of the blade(s) may still be exposed to corrosive/erosive species flowing over the compressor wheel.

The trailing edge and/or blade root of the blade(s) provided with the coating may have a ceramic layer with a thickness of around 1 to 10 microns, more preferably around 2 to 5 microns. The blade root area of the suction surface of one or more of the blades in the exducer portion of the compressor wheel may be provided with a ceramic layer that is no more than around 5 microns thick, more preferably around 1 to 4 microns thick at a location that is around 10 to 15% of the diameter of the exducer from the outer diameter of the compressor wheel.

In a preferred embodiment, the leading edge of at least one blade of the compressor impeller is provided with a ceramic layer having a thickness of around 20 microns, and both the trailing edge and blade root have ceramic layers around 3 microns thick.

It will be appreciated that the trailing edge of the or each blade may be provided with a ceramic coating having substantially the same thickness as the root of the or each blade, or the trailing edge and root of the or each blade may have ceramic layers of different thickness. It may be preferable for the trailing edge to have a thicker ceramic layer than the blade root in applications where operational stresses are greater at the blade root than the trailing edge of the blade and so it would be desirable to minimise the thickness of the ceramic coating, which can reduce fatigue life, at the blade root whilst still ensuring that the blade root has a sufficient thickness of ceramic coating to afford a required level of corrosion/erosion resistance. In such circumstances, it may be desirable to produce a blade having a ceramic thickness at the leading edge of around 20 to 40 microns, at the trailing edge or around 15 to 20 microns, and at the blade root of around 1 to 10 microns.

Other advantageous and preferred features of the invention will be apparent from the following description.

Specific embodiments of the present invention will now be described, by way of example only, with reference to the accompanying drawing, in which.

Figure 1:
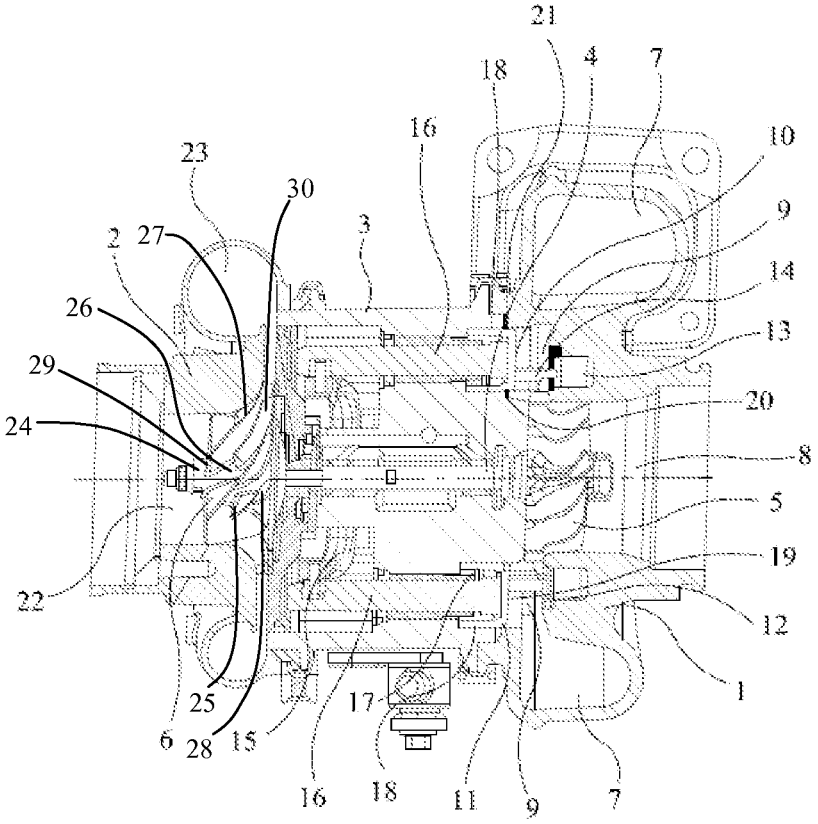
FIG. 1 is an axial cross-section through a variable geometry turbocharger incorporating a compressor wheel according to a first aspect of the present invention.

FIG. 1 illustrates a variable geometry turbocharger comprising a housing incorporating a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing 3.

The turbine housing 1 defines an inlet volute 7 to which gas from an internal combustion engine (not shown) is delivered. The exhaust gas flows from the inlet volute 7 to an axial outlet passage 8 via an annular inlet passage 9 and the turbine wheel 5. The inlet passage 9 is defined on one side by a face 10 of a radial wall of a movable annular wall member 11, commonly referred to as a "nozzle ring", and on the opposite side by an annular shroud 12 which forms the wall of the inlet passage 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passage 9. The vanes 14 are orientated to deflect gas flowing through the inlet passage 9 towards the direction of rotation of the turbine wheel 5. When the nozzle ring 11 is proximate to the annular shroud 12, the vanes 14 project through suitably configured slots in the shroud 12, into the recess 13.

The position of the nozzle ring 11 is controlled by an actuator assembly of the type disclosed in U.S. Pat. No. 5,868,552. An actuator (not shown) is operable to adjust the position of the nozzle ring 11 via an actuator output shaft (not shown), which is linked to a yoke 15. The yoke 15 in turn engages axially extending actuating rods 16 that support the nozzle ring 11. Accordingly, by appropriate control of the actuator (which may for instance be pneumatic or electric), the axial position of the rods 16 and thus of the nozzle ring 11 can be controlled. The speed of the turbine wheel 5 is dependent upon the velocity of the gas passing through the annular inlet passage 9. For a fixed rate of mass of gas flowing into the inlet passage 9, the gas velocity is a function of the width of the inlet passage 9, the width being adjustable by controlling the axial position of the nozzle ring 11. FIG. 1 shows the annular inlet passage 9 fully open. The inlet passage 9 may be closed to a minimum by moving the face 10 of the nozzle ring 11 towards the shroud 12.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet volute 7 to the outlet passage 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown).

Figure 2:
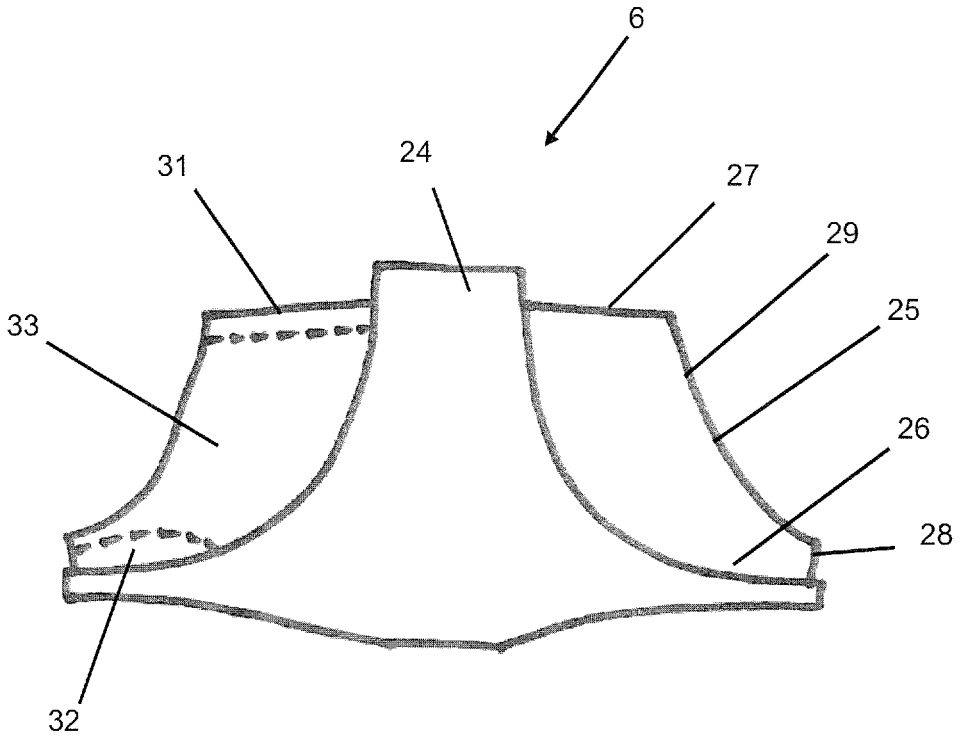
FIG. 2 is a side view of a compressor wheel according to a preferred embodiment of the first aspect of the present invention marked-up to illustrate areas of different coating thickness.

With reference to FIGS. 1 and 2, the compressor wheel 6 comprises a central hub 24 which is mounted on the turbine shaft 4 and a plurality of impeller blades 25 which extend radially outwardly from the hub 24. Each blade 25 is connected to the hub 24 at a root portion 26 of the blade 25. Each blade 25 defines a leading edge 27 which impinges upon incoming air before the rest of the blade structure and an opposite trailing edge 28 over which air flows last before exiting to the outlet volute 23. The impeller blades 25 comprise a first set of axially longer main blades 29 and a second set of axially shorter blades 30 (for clarity only a pair of the longer blades 29 are shown in FIG. 2). The main blades 29 extend radially from the radially inner inducer portion of the compressor wheel 6 to the radially outer exducer portion of the compressor wheel whereas the shorter blades 30 reside essentially just in the exducer portion of the compressor wheel 6.

The turbocharger shown in FIG. 1 is connected to an exhaust gas recirculation (EGR) system (not shown) so that a portion of the exhaust gases exiting the turbine stage of the turbocharger via the outlet passage 8 is recirculated back to an EGR mixer unit (not shown) where the exhaust gases mix with incoming ambient air before being fed to the compressor air inlet 22. The exhaust gases may include a wide range of different chemical species and/or particulates which are potentially harmful to the integrity of the structure of the compressor wheel blades 25. Chemically corrosive species include acidic compounds with a pH of less than around 3 or 4. Gaseous pollutants include uncombusted hydrocarbons, nitrogen oxides and carbon monoxides. Particulate matter which may be entrained in exhaust gases includes not only unburned carbonaceous matter from fuel, but also metallic or ceramic particulates derived from engine fluids (oil, coolant etc) and worn engine or exhaust components. It can therefore be appreciated that as a result of adopting an EGR system, the compressor wheel blades 25 are exposed to a much wider range of potentially harmful substances than when air alone is fed to the compressor 2.

In the compressor wheel shown in FIG. 1, the blades 25 of the compressor wheel 6 have been subjected to a surface treatment process to provide each blade 25 with a surface which is resistant to corrosion and erosion by corrosive species and particulate matter within the exhaust gases flowing over the blades 25, and which is also resistant to the initiation or propagation of cracks across the blade surface and within the blade structure to afford the blades 25 with good low cycle fatigue life performance.

Referring to FIG. 2, an area 31 at and adjacent to the leading 27 of each blade 25 has been provided with a relatively thick layer of an erosion resistant material, such as an oxide of the material from which the blade is formed (e.g. an aluminium oxide coating in the case of an aluminium compressor wheel). A further area 32 at and adjacent to the root portion 26 and trailing edge 28 of each blade 25 has been provided with a relatively thin layer of the same coating material. The area 33 of the blade surface in between these two areas 31, 32 is provided with a layer of the same coating material but of a thickness which is intermediate between the thickness of the two other areas 31, 32. The coating near the leading edge area 31 has a substantially uniform thickness across the area 31 of around 14 to 20 microns. The coatings near the trailing edge and blade root areas 32 have a thickness of no more than around 4 microns. The intermediate area 33 has a coating which reduces in thickness in a consistent manner from the thicker area 31 to the thinner area 32.

Figure 3:
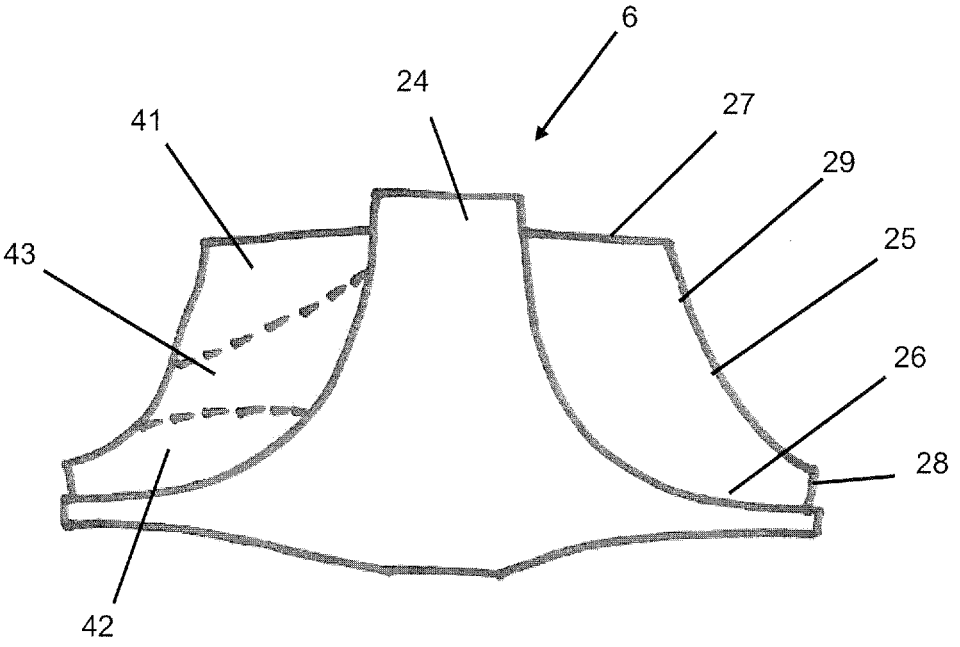
FIG. 3 is a side view of a compressor wheel according to an alternative preferred embodiment of the first aspect of the present invention marked-up to illustrate areas of different coating thickness.

Referring now to FIG. 3, this shows an alternative embodiment of a coated blade to that shown in FIG. 2. In FIG. 3, larger areas of the surface of each blade 25 have been provided with the thicker and thinner coating layers than the corresponding areas in the embodiment shown in FIG. 2. As a result, the intermediate area of coating is smaller. The same numbering is used in FIG. 3 as in FIG. 2 save for the areas of the coating which have been increased by 10. The area of each blade 25 provided with a relatively thick layer of an erosion resistant material encompassing the leading edge 27 is area 41; the area of each blade 25 provided with a thinner layer of an erosion resistant material encompassing the blade root 26 and the trailing edge 28 is area 42; and the area of each blade 25 intermediate areas 41 and 42 is area 43. In the embodiment shown in FIG. 3 each of the three areas 41, 42, 43 have substantially uniform coating layer thicknesses such that the boundaries between each area, shown as dotted lines, are stepped. That is, the thickness of the coating is uniform across area 41 from the leading edge 27 of each blade towards the trailing edge 28 and blade root 26 and then the thickness of the coating layer reduces at the boundary shown as a dotted line in FIG. 3 to a thinner coating across intermediate area 43 which is itself uniform across area 43 until it the boundary with the thinner area 42 is reached at which point the thickness of the coating reduces again and is then uniformly thin across area 42.

It will be appreciated that the graduated intermediate coating described above in relation to FIG. 2 can be employed in blades having relatively large areas of the thickest and thinnest coating areas as described in relation to FIG. 3 and vice versa. Moreover, it may be convenient in some applications to combine a relatively small area of thickest coating adjacent the leading edge as in FIG. 2 with a relatively large area of thinnest coating near the trailing edge and blade root as in FIG. 3, or vice versa.

The blade surface treatment process is preferably carried out in two steps as explained more fully below.

First, the impeller blades are subjected to a process which plastically deforms the surface of the blades to induce residual compressive stresses at the surface of the blades with the aim of increasing fatigue life. Shot peening is preferred for typical aluminium compressor wheel blades, although any suitable surface treatment process can be employed, such as laser peening, provided it affords the required level of residual compressive stress and does not hinder the second and third steps described below. Exemplary shot peening parameters for an aluminium compressor wheel are set out below.

Type of Shot: Glass bead
Size of Shot: Size 'C' (0.250 mm to 0.425 mm)
Intensity: 0.203 to 0.305 mm (Test strip N)

Second, the shot peened surface of the impeller wheel blades is provided with a surface layer of a corrosion resistant ceramic material whose thickness varies to a predetermined extent across the surface of the blade. It is preferred that this is achieved by subjecting the blades to plasma electrolytic oxidation (PEO) to convert aluminium at the surface of the blade to aluminium oxide and thereby provide a conversion coating of the ceramic. Other processes can be used, such as conventional anodising, but PEO is preferred since the higher potentials typically employed usually produce more crystalline and therefore harder coatings. The PEO process builds up a surface layer of aluminium oxide ceramic which extends above and below the original aluminium surface and which is very strongly adherent to the underlying aluminium body of the blade. Any microscopic pores in the aluminium oxide surface layer or adjacent aluminium surfaces remaining after the oxidation process are filled with a compatible sealant, such as a suitable fluoropolymer, sol-gel or silicate. The sealant can be applied by any suitable means including, but not limited to dipping, spraying or painting.

The process should be carried out to produce blades having a thicker ceramic conversion coating along the leading edge of each blade and a thinner coating along the trailing edge and/or blade root, i.e. the high stress region where the blade joins the central hub of the impeller wheel. Preferably each blade has a surface ceramic layer that is up to around 40 microns thick at the blade leading edge and no more than around 1 to 10 microns thick at the trailing edge and blade root. The interface of the regions of different thickness may be stepped, graded or continuous. That is, the blade surface may have essentially two discrete areas of different thickness, a first area at and adjacent to the leading edge where the ceramic layer is up to around 40 microns thick, and a second area covering the remainder of the blade including the trailing edge and the blade root where the ceramic layer is around 1 to 10 microns thick. Alternatively, a small region at the interface of the two areas of different thickness may be graded to smooth out the otherwise steep step between the two areas. As a further alternative, the thickness of the ceramic coating may decrease from the leading edge to the trailing edge and blade root in an essentially continuous or linear manner, ignoring insignificant and unavoidable microscopic irregularities in ceramic layer thickness arising from the coating process.

In a preferred embodiment, within 1 mm of the leading edge of the coated blade(s) the ceramic coating has a thickness of around 14 to 20 microns. It is further preferred that the ceramic coating has a maximum thickness of around 4 microns on the exducer suction surface blade root area of the coated blade(s) at a location that is 10 to 15% of the exducer diameter from the outer diameter of the compressor wheel carrying the coated blade(s). By way of example, for a compressor wheel having an outer diameter of 85 mm, it is desirable that the ceramic coating on the exducer suction surface blade root area of the coated blade(s) is no more than around 4 microns thick at a position that is around 8.5 mm to 12.75 mm from the outer diameter of the compressor wheel.

The variation in thickness of the ceramic conversion coating can be achieved in a number of different ways depending, in part, upon the particular process chosen to form the surface layer. By way of example, when PEO or more conventional anodising is used, different sections of the impeller blades can be immersed in the electrolyte to a varying extent and/or over a varying period of time. The different sections of the blades could be differentially exposed to a single type of electrolyte gradually over a period of time during a single step process, or stepwise during a multistep process. Additionally, the different sections of the blades could be exposed to different types of electrolytes in a gradual or stepwise manner. The different sections of the blade to be coated could be alternately masked or shielded from particular treatment steps, for example by the use of wax or some other form of material whose resistance to the current treatment step being carried out remains throughout that treatment step or reduces during treatment so that the masked region is masked only in the initial stage of the treatment. Other parameters of the surface treatment process could also be varied to provide the desired variation in ceramic coating across the blade surface. For example, the blade could be treated using different arrangements of electrodes around the blade or by arranging the electrodes so that they are physically closer to the leading edge of the blade, where the thicker coating is required, than the trailing edge of the blade and/or blade root where a thinner coating is required.

The resulting aluminium oxide ceramic layer on the shot peened surface is significantly more resilient to corrosion and is much harder than the original aluminium surface. It has been observed that impeller blades treated in this way exhibited a Knoop hardness of around 800 to 1200 HK or 800 to 1200 kgf/mm$^2$ which is equivalent to a Vickers hardness of around 800 to 1600 HV.

Shot peening of the impeller blades contributes to improving the fatigue life of the coated compressor wheel. While the inventors do not wish to be bound by any particular theory, it is believed that this may be due, at least in part, to the plastic deformation process reducing fatigue crack initiation and/or propagation. This is particularly important in high stress areas of the blade. Moreover, the ceramic coating provides resistance to corrosion and erosion. Providing the coating so that it is thickest where corrosion/erosion is of paramount importance but thinnest where operationally-induced stresses are highest provides a blade with an optimum balance of corrosion/erosion resistance and increased fatigue life thereby making the blade more durable than existing blades.

The invention claimed is:

1. A compressor wheel for a turbocharger comprising a central hub and a plurality of impeller blades extending outwardly from the hub, each of the blades defining a leading edge, a trailing edge and a root portion which connects the blade to the hub, at least one of the blades having a surface provided with a variable thickness surface layer of a ceramic material, the leading edge of the blade being provided with a thicker surface layer of the ceramic material than at least one of the trailing edge and the root portion of the blade, wherein said surface of the at least one blade is a plastically deformed surface and the ceramic layer has a thickness of around 10 to 25 microns within 1 mm of the leading edge of the blade and a thickness that is no more than 5 microns at a root area of a suction surface of the blade in an exducer portion of the compressor wheel.

2. A compressor wheel according to claim 1, wherein the ceramic layer comprises an oxide of a material comprised in said surface of the at least one blade.

3. A compressor wheel according to claim 1, wherein the ceramic layer comprises an oxide of a material from which said at least one blade is manufactured.

4. A compressor wheel according to claim 1, wherein the ceramic layer is a conversion coating produced by oxidising said surface of the at least one blade.

5. A compressor wheel according to claim 1, wherein the variable thickness ceramic layer is up to 10 microns thick at the trailing edge of the at least one blade.

6. A compressor wheel according to claim 1, wherein the ceramic coating on the root portion of the at least one blade is no more than 4 microns thick at a location that is 10 to 15% of the diameter of the exducer section of the compressor wheel from the outer diameter of the compressor wheel.

7. A compressor wheel for a turbocharger comprising a central hub and a plurality of impeller blades extending outwardly from the hub, each of the blades defining a leading edge, a trailing edge and a root portion which connects the blade to the hub, wherein at least one of the blades has a surface provided with a variable thickness surface layer of a ceramic material, the leading edge of the blade being provided with a thicker surface layer of the ceramic material than at least one of the trailing edge and the root portion of the blade, wherein the ceramic layer decreases in thickness linearly from the thicker layer at the leading edge of the blade to the thinner layer at said at least one of the trailing edge and the root portion of the blade.

8. A turbocharger comprising:

a housing;

a turbine wheel supported on a shaft within said housing for rotation about a turbine axis; and a compressor wheel supported on said shaft within said housing, said compressor wheel comprising a central hub and a plurality of impeller blades extending outwardly from the hub, each of the blades defining a leading edge, a trailing edge and a root portion which connects the blade to the hub, at least one of the impeller blades having a surface provided with a variable thickness surface layer of a ceramic material, the leading edge of the blade being provided with a thicker surface layer of the ceramic material than at least one of the trailing edge and the root portion of the blade, wherein said surface of the at least one blade is a plastically deformed surface and the ceramic layer has a thickness of around 10 to 25 microns within 1 mm of the leading edge of the blade and a thickness that is no more than 5 microns at a root area of a suction surface of the blade in an exducer portion of the compressor wheel.

9. A turbocharger according to claim 8, further comprising an exhaust gas recirculation system to pass a portion of exhaust gas exiting the housing having contacted the turbine wheel back to the housing to contact the compressor wheel.

10. A method for manufacturing a compressor wheel for a turbocharger, the compressor wheel comprising a central hub and a plurality of impeller blades extending outwardly from the hub, each of the blades defining a leading edge, a trailing edge and a root portion which connects the blade to the hub, wherein the method comprises providing a surface of at least one of the blades with a variable thickness surface layer of a ceramic material such that the leading edge of the blade is provided with a thicker surface layer of the ceramic material than at least one of the trailing edge and the root portion of the blade, the ceramic layer having a thickness of around 10 to 25 microns within 1 mm of the leading edge of the blade and a thickness that is no more than 5 microns at a root area of a suction surface of the blade in an exducer portion of the compressor wheel, wherein said surface of the at least one blade is subjected to plastic deformation prior to the provision of the layer of ceramic material.

11. A method according to claim 10, wherein plastic deformation is achieved using a method selected from the group consisting of shot peening and laser peening.

12. A method according to claim 11, wherein the layer of ceramic material is provided on the surface of the at least one blade by an oxidation process, optionally selected from the group consisting of plasma electrolytic oxidation and anodisation.

13. A method according to claim 11, wherein the layer of ceramic material is treated with a sealant, optionally selected from the group consisting of a fluoropolymer, a sol-gel and a silicate.

* * * * *